United States Patent [19]

Cowans et al.

[11] 4,340,778

[45] Jul. 20, 1982

[54] SPEAKER DISTORTION COMPENSATOR

[75] Inventors: Kenneth W. Cowans, Encino; M. Owen Bennett, Agoura, both of Calif.

[73] Assignee: Bennett Sound Corporation, Tarzana, Calif.

[21] Appl. No.: 93,839

[22] Filed: Nov. 13, 1979

[51] Int. Cl.[3] ..... H04R 3/00

[52] U.S. Cl. ..... 179/1 D; 179/1 P; 179/1 A; 179/115.5 H; 179/115.5 VC

[58] Field of Search ..... 179/1 D, 1 F, 1 R, 1 A, 179/1 P, 115.5 H, 115.5 VC

[56] References Cited

U.S. PATENT DOCUMENTS

| | | | |
|---|---|---|---|
| 2,638,510 | 5/1953 | Bromi | 179/115.5 H |
| 2,802,054 | 8/1957 | Corney | 179/1 D |
| 3,838,217 | 9/1974 | Dreyfus | 179/1 A |
| 3,937,887 | 2/1976 | Miller | 179/1 F |
| 4,109,107 | 8/1978 | Boast | 179/1 D |
| 4,113,983 | 9/1978 | Steel | 179/1 D |
| 4,118,600 | 10/1978 | Stahl | 179/1 D |
| 4,130,726 | 12/1978 | Kates | 179/1 D |
| 4,130,727 | 12/1978 | Kates | 179/1 D |
| 4,229,618 | 10/1980 | Gamble | 179/1 A |
| 4,243,840 | 1/1981 | Kates | 179/1 D |

OTHER PUBLICATIONS

*Acoustics* by Beranek ©1954 McGraw-Hill Book Co. pp. 91-93, 96.

*The Radiation and Scattering of Sound* by Morse pp. 240-247.

"Closed Box Loudspeaker Systems," by Small, pp. 798-808, 11-18, Journal of Aud.-Eng. Soc., Dec. 1972, vol. 20, No. 10.

*Primary Examiner*—Bernard Konick
*Assistant Examiner*—Alan Faber
*Attorney, Agent, or Firm*—Fraser and Bogucki

[57] ABSTRACT

In sound generating systems, it has been ascertained that various factors cause spurious, audible emanations when transducers of reasonable size and cost are driven in complex motions characteristic of typical high fidelity audio reproduction. It is shown that phase effects, unidirectional components, and transient (start-stop) effects give rise to such spurious emanations and that these center about the resonant frequency of the transducer. Means are disclosed which significantly improve the clarity of reproduction by minimizing these spurious emanations. In a typical system in which different transducers are used for different frequency ranges, the spurious emanations are reduced by change of amplitude or frequency or both, without affecting transducer performance, to levels at which they are substantially inaudible. Either or both electronic and acoustic techniques may be used for these purposes.

32 Claims, 12 Drawing Figures

90
HIGH PASS FILTER
HIGH RANGE COMPENSATION CIRCUIT
INPUT SIGNALS
106
20K
97
98
100
102
3.9K
.001
.001
160K
99
.01
103
96
6.2K
.01
.01
132
47K
10K
100K
10K
510K
510K
0.1
20K
130
20K
92
111
75K
108
100K
SUMMING JUNCTION
75K
110
75K
POWER AMPLIFIER
HIGH RANGE SPEAKER
32
24
114
MID RANGE FILTER
.01
47K
.01
.01
.01
5.1K
116
4.7K
1.6K
MID RANGE COMPENSATION CIRCUIT
POWER AMPLIFIER
MID RANGE SPEAKER
93
31
23
LOW PASS FILTER
123
100K
75K
120
124
75K
122
75K
LOW RANGE COMPENSATION CIRCUIT
POWER AMPLIFIER
LOW RANGE SPEAKER
94
30
22
CROSSOVER NETWORK

SPEAKER DISTORTION COMPENSATOR

BACKGROUND OF THE INVENTION

It is well recognized that the problems of reproducing sound with high fidelity and clarity involve a multiplicity of subtle factors. The instrument or human organ whose sound has been recorded is not a pure or monofrequency sound source, the waveforms involved are complex, intermittent, and at times asymmetrical, and the transducer which is to reproduce the sound is necessarily a different type of sound source than the original. The transducer is moreover a complex electromechanical mechanism which exhibits its own resonance and mode characteristics under excitation; and the media and structure into which the forward and backward waves are transmitted react with the transducer to affect both transducer operation and the quality of the sound. It is, of course, feasible to use large horns or other loudspeakers for improved efficiency and for better impedance matching to the sound-receiving volume. However, the cost and size of such speaker systems limits their use to a relatively small proportion of the total number of installations. The great majority of high fidelity audio installations comprise a set of transducers, each excited in a different frequency range, such as the common woofer, mid-range and tweeter combination.

Many studies have been undertaken of the response and distortion characteristics of loudspeaker systems and the specifications of the speakers are usually stated in terms of linearity of response over the frequency band, as well as various measurable distortions. These data are commonly derived from analyses made using pure excitation frequencies, singly or in limited combinations, with the assumption being made that the resultant graphs and figures of merit establish performance quality for all modes of operation. It is well recognized, however, that human responses are based upon much more arcane and complicated evaluative factors. The loudspeaker must be regarded as an imperfect mechanism in comparison to the ear, which is a profoundly competent instrument that is responsive to almost immeasurable differences in sound reproduction. Thus, just as the seeing organs are acutely sensitive to visible wavelength differences, the ear is sensitive to minute phase, pitch, resonance and shading effects in high fidelity reproduction of complex sounds. A major advance in this art does not therefore entail an improvemnt in multiples or orders of magnitude, but only a fractional or low percentage improvement, if it is of a quality that is detectable by the ear.

As far as is known, workers in the art have not significantly considered the differences in character and dynamics of sound emanating from different types of sources. The typical small loudspeaker is, in the parlance of the art, described as a simple source or point source, as set forth in the book "Acoustics" by L. L. Beranek, published in 1954 by the McGraw-Hill Book Company, a basic work in the field. Other sources, such as the sounding board of a piano, are much more complicated generators of sound, and are typically much longer with relation to the wavelength of many of the sounds that are generated. While a loudspeaker cone is typically less in diameter than one-fourth of the wavelength of the sound which it must generate, the sounding board of a piano can be much longer than such wavelengths. Thus, a piano sounding board here may be termed an extended source, to distinguish it from the simple source. Workers in the art have heretofore analyzed extended sources of sound on a theoretical and steady state basis in terms of an array of point sources which act by diffraction and interference effects to provide a principal radiation lobe and side lobes which can be characterized in general terms. However, this type of analysis does not suffice for a highly interactive structure such as a piano sounding board when excited by multi-frequency waves which furthermore can be intermittent in character. A wholly different type of extended source is the human voice, which has both variable excitation organs and a variable sound chamber. Such extended sources generate sounds which contain unidirectional components, varying phase components, and transient effects, which may be visualized as sharp leading and trailing edge waveforms. Thus, it is not correct to try to envision the total interactive response of a transducer in terms of measurable responses to pure steady state single frequencies or combinations of frequencies from a standardized oscillator or other pure source. In this connection, one can recognize that the accurate reproduction of normal human speech is extremely difficult, and that even an idiosyncratic high fidelity enthusiast accepts as normal a substantial deterioration in reproduction quality from this type of source. It has been ascertained, as discussed in detail below, that the mentioned factors in complex acoustic programming material cause spurious simple source emanations when attempted to be reproduced in conventional speaker systems. The spurious simple source emanations are inherently accepted by listeners as inevitable, until exposed to sound reproduction from which the emanations are absent. The present invention represents both a discovery of the causes and character of spurious simple source emanations and a teaching of various practical resolutions of the problem.

PRIOR ART

A common technique for modifying or improving the frequency response of a loudspeaker is to filter the input in a selective way, and there are many variations of this technique. A relatively recent example is the U.S. patent to Steel, No. 4,113,983, in which a controllable filter is employed to minimize travel of the speaker cone outside the normal range of movement, with an attendant "bottoming" effect in the reproduced sound. Further, a bass equalizing circuit having a frequency response that is the inverse of the low end frequency response of the system is employed, in an attempt to derive output sound pressure proportional to the input at the equalizing circuit. This is a more complex filtering-equalization technique than is ordinarily used but it is readily seen that spurious sound emission problems are neither comprehended nor resolved.

A somewhat related approach is disclosed in the U.S. patent to Stahl, No. 4,118,600, which is directed to improving the bass response of a speaker. To this end an electrical network at the speaker input has a negative resistance component equal in magnitude to the voice-coil resistance, and parallel impedances coupled in series with the negative resistance then influence the bass response. The net result is a lowering of the resonant frequency of the woofer by reduction of the cutoff point and the Q of the speaker. Such a technique relies on a parallel relationship between electrical components and mechanicalelectrical equivalents to change the "apparent" mass and damping of the speaker as a byproduct. It is of benefit only in lowering the cutoff frequency, and is inapplicable to the problem of spurious emanations, which is indeed not recognized in the patent.

In the theoretical analysis of electrodynamic loudspeakers in the current state of the art, it is well known to construct electrical equivalent circuits of the dynamic mechanism, representing mass as an inductance and the like, as shown and discussed in articles by R. H. Small entitled "Closed-Box Loudspeaker Systems, Part 1: Analysis" and "Part II Synthesis" in Vol. 20, No. 10, pp. 798–808 (December 1972) and Vol. 21, No. 1, pp. 11–18 (January/February 1973) of the Journal of the Audio Engineering Society. These analogs are used to enable a designer to effect tradeoffs between frequency response, efficiency bandwidth and enclosure volume. Small shows (FIG. 6 on p. 802 of Vol. 20, No. 10) that the response of a closed-box system to a step input becomes more oscillatory with increasing Q. However, the assumption is that modern low output impedance amplifiers and modern acoustic and mechanical damping insure adequate limitation of resonances. Because of this assumption and the tendency to consider frequency response in terms of response to pure sine waves, workers in the art have not heretofore confronted or appreciated the adverse effects of spurious emanations. These effects are present to some degree and in different ways in each component speaker in a set of speakers covering different frequency ranges. As pointed out by Small on p. 10 of Vol. 21, No. 1, resonance frequencies for closed-box bass systems range from 40 Hz to 90 Hz, while personal perferences are strongly influenced by bass response characteristics. However, with continuing improvement of signal recording and reproduction processes (e.g., digital signal processing and direct-to-disk recordings), any discernible improvement in the sound quality achieved with a given set of dynamic coil speakers is of significant importance.

The basic concept of the U.S. patents to Kates et al Nos. 4,130,726 and Kates 4,130,727 is to combine, linearly, the input signal and at least one delayed replica of the input signal, with the delay being typically half the period of a resonance of the transducer. The amplitude-frequency response characteristic of the transducer resulting from mechanical resonance is thus altered by introducing opposing variations in the characteristic of the drive system for the transducer, but based solely on the delayed replica.

SUMMARY OF THE INVENTION

Methods and systems in accordance with the invention nullify or substantially eliminate the effects of spurious emanations from simple source transducers that are excited with complex waves. The spurious simple source emanations are reduced to effectively inaudible levels by electronic or acoustic interaction with the transducer prior to or during excitation.

In an example of an electronic system in accordance with the invention, each individual transducer, or group of transducers for a particular frequency, is driven separately from transducers for other frequencies. An input signal covering the audio band is subdivided into different frequency ranges, and each signal is processed through an analog circuit presenting a model of the associated transducer dynamics including mass, compliance and damping of the transducer. The model may also include the voice coil of the transducer and the acoustic load into which it operates. The analog circuit introduces compensation into the signals in accordance with the response image of the transducer, so that the transducer velocity variations result in pressure waves that correspond to the original input signal in precise fashion. The processing circuits are exemplified by active and passive circuits which provide a feedforward component which nullifies the spurious emanations that would otherwise develop as the transducer attempts to follow complex motions that are otherwise essentially impermissible by virtue of its dynamics. Both voltage mode and current mode exemplifications are disclosed.

In an acoustic system in accordance with the invention, a transducer for a given range of frequencies is mounted within the opening of a horn having a matched termination, providing inductive backloading for the backward wave such that the speaker phase accuracy is maintained to frequencies will below the crossover frequency.

For a multiple transducer system, higher frequency speakers may be arranged in conjunction with the cutoff points of a crossover network to place the spurious simple source emanations in extremely low efficiency regions so that they become humanly inaudible. In different examples of systems in accordance with the invention the processing circuits may include compensation for a ported speaker enclosure, or may be simplified by assuming that the coil reactance is zero and that the acoustic load is purely inductive.

It is also a feature of the invention to arrange the crossover network such that a spurious signal component is deliberately introduced for one speaker in a crossover region, so as to provide certain advantages in speaker response. However, an opposing signal component is also introduced in the crossover region for the speaker in the next lower frequency region, and the signal components are acoustically cancelled.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION-BACKGROUND

Figure 2:
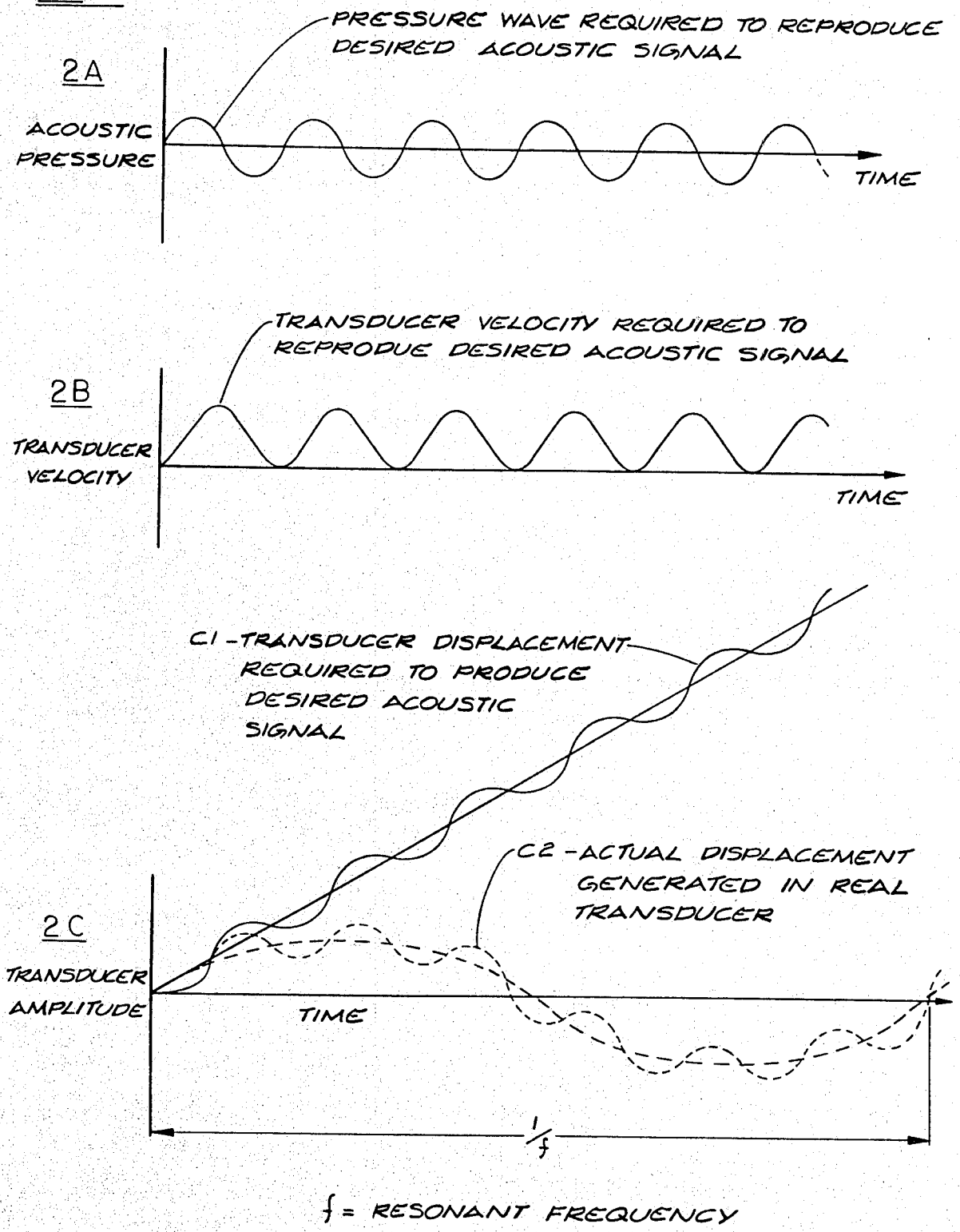
FIG. 2, consisting of A–C, is a waveform diagram, showing sound pressure variations, sound source velocity, sound source displacement and other excursions varying in amplitude relative to the ordinate with respect to time as the abscissa.

It should intuitively be apparent that complex sounds, such as music and the human voice, do not correspond to a complex of pure sine waves, even where relatively long term and monofrequency tones are involved. The air which excites the human vocal cords, for example, causes changes in pressure with time, but this air flow occurs in only one direction. Thus, the amplitude shown as needed in FIG. 2B can in fact be maintained by the voice or by any simple source created by a uniform flow (flutes, organ pipes, etc.). However, a loudspeaker cone which is attempting to perform the necessary excursions to reproduce the pressure wave of FIG. 2A cannot do so because it must center its motions about its midplane position. The presence of a unidirectional component in the velocity wave as shown in FIG. 2B requires in theory that the speaker cone oscillate about an ascending mid line, as shown by waveform C in FIG. 2C, in order to generate the desired pressure wave shown by the waveform in FIG. 2B. However, this motion cannot be duplicated beyond the maximum excursion of the speaker cone, which instead responds by undergoing a slower term oscillation having the periodicity of its resonant frequency, as shown by waveform C2 in FIG. 2C. This is an example of a spurious simple source emanation, and it is usually in the audible range.

In related fashion, step inputs (starting or stopping transients) contain complex waveform components and can have uniform flow components as well. The speaker cone again responds by generating sounds accompanied by spurious simple source emanations, at or near the resonant frequency.

The leading edge of a complex sound waveform may be comparable in some senses to the leading edge of a rectangular pulse, in that it contains, according to Fourier analysis, multiple waves of different frequencies. Furthermore, these waves can be asymmetrical or contain a unidirectional component. Similarly, the trailing edges of sounds involve nonlinear damping as well as sharp trailing edge characteristics, rather than a gradual diminution in amplitude of a bidirectional sinusoidal wave or set of waves. Consequently, the simple source which is required to duplicate these motions with what must be a bidirectional dynamic motion about a midplane, is unable to do so without introducing its own spurious emanations. Inasmuch as music and speech typically involve a continuity of transient effects, the result is a loss in clarity to which the ear becomes desensitized after hearing a sufficient amount of sound reproduction that is accompanied by spurious simple source emanations.

In other words, the classical picture of a source of sound as expanding and contracting, with consequent forward and reverse acceleration of particles, applies only where motion and size of the sound generator is directly comparable (i.e., symmetrical about a midplane, which may be shifted with time but must be maintained between predetermined maxima and minima).

An important cause of spurious emanations from a simple source is the relationship of the wavelength of the sounds or sound originally produced to the size of the radiating source. In the book "The Radiation and Scattering of Sound" by Morse, the simple source of sound is analyzed in terms of a vibrating sphere which has a small radius as compared to the length of the sound radiation. At page 242, Morse shows that for this theoretical model the pressure at a distance r that is generated is proportional to the rate of change of flow of air at a time (r/c) earlier. The behavior of the radiation is much the same regardless of the shape of the radiator, as long as the motion of all parts of the radiator is in phase, which is the situation that applies to a loudspeaker cone. Morse also describes this as applicable to typical simple sources, such as the open end of an organ pipe or of a wood wind instrument. However, as pointed out at pages 244–247, development of a general treatment for the wave equation relative to a sound source such as a sphere is much more complex. The development further shows that as the length of the sound source becomes greater relative to the sound wavelength, the radiation changes from symmetrical to directional as the frequency of the radiated sound increases.

Furthermore, the directional characteristic appears at a distance from the sound source, in the manner of far field radiation from any extended antenna structure. Whereas the pressure wave at a distance from a simple sound source varies in accordance with the acceleration, the pressure wave at distance from the extended sound source varies in accordance with the velocity. There is thus a significant phase difference in the sound that is dependent upon the nature of the emanating source, and such phase variations cause a dynamic loudspeaker to react differently, depending upon the relationship to the resonant frequency of the loudspeaker. Such phase shifts relative to resonant frequency will be recognized as the typical response of a resonant circuit to an exciting signal of varying frequency. The resonant system in this instance is, of course, the dynamic mechanism of the loudspeaker operating into an acoustic load. Consequently, when sounds emanating from an extended source contain wavelengths that are relatively substantially shorter than the length of the source, even though a simple harmonic motion is involved, the dynamic loudspeaker driven in normal fashion is unable to duplicate the required motion. An extended sound source in this description is taken as one having a diameter substantially greater than the wavelength of the generated sound, while a simple source is taken as one having a diameter that is less one-quarter of the wavelength of the generated sound.

For physical acoustic generating transducers, the effect of the associated parameters of mass, compliance, and resistance in response to complex multi-frequency waves can be shown to result in spurious emanations in mathematical terms. As an example, the simply enclosed electrodynamic loudspeaker can be closely represented in Laplace operational mathematical terms by the following equation:

$$P(s) = E(s)\frac{1}{R_1K_1}\quad\frac{C_4S}{1+(C_2+C_4)S+\frac{1}{L_3S}}$$

where:

P(s) is the sound pressure across the acoustic load.

E(s) is the electrical input signal which is directly proportional to the acoustic signal to be reproduced.

$K_1$ is the coupling coefficient between the electrical and mechanical circuits.

$R_1$ is the combination of mechanical and electrical resistance.

$C_2$ is the mechanical mass of the transducer.

$L_3$ is the compliance between the mass and the combination of the structure and enclosure.

$C_4$ is the mass of the acoustic load.

S is the Laplace operator.

This model makes two simplifying assumptions:

1. The inductance of the voice coil in the electrodynamic loudspeaker is assumed to be zero.
2. The acoustic load on the speaker is assumed to be entirely reactive.

These assumptions are generally valid over the useful bandwidth of the transducer. Actually, as shown on page 120 of Beranek the acoustic load has a cutoff characteristic with frequency. The equation can be rewritten as:

$$P(s) = \frac{E(s)}{R_1K_1}\left(\frac{\frac{C_4}{C_5}S^2}{W_1^2+2\alpha W_1S+S^2}\right)$$

where:

$C_5=C_2+C_4$ $W_1^2=1/L_3C_5$ $2\alpha W_1=1/R_1C_5$

The input signal E(s) can take on many forms as it can come from a variety of sources, such as musical, spoken voice, and noise sources. The effect of interest here can be demonstrated by use of an input which is the sum of a cosine and a sine wave.

$$e(t)=E_1\cos Wt+E_2\sin Wt \text{ for } t\geqq 0$$

where:

$E_1$ is the amplitude of the input signal.

$W=2\pi f$ f is the frequency t is time then:

$$E_s = \frac{E_1W}{S_2+W_2}+\frac{E_2S}{S_2+W_2}$$

Substituting gives:

$$P(s) = \frac{1}{R_1K_1}\left(\frac{E_1W}{S^2+W^2}+\frac{E_2S}{S^2+W^2}\right)\left(\frac{C_4/C_5\,S^2}{W_1^2+2\alpha W_1S+S^2}\right)$$

This can be expanded to give an equation of the form:

$$P(s) = \frac{A_1}{S^2+W^2}+\frac{A_2S}{S^2+W^2}+\frac{A_3}{W_1^2+2\alpha W_1S+S^2}+\frac{A_4S}{W_1^2+2\alpha W_1S+S^2}$$

where:

$A_i$ are coefficients of the terms.

The inverse transform of this expression is of the form:

$$p(t)=B_1\sin Wt+B_2\cos Wt+B_3e^{\alpha t}\sin W_1l^{-\alpha 2}lt+B_4e^{-\alpha t}\cos W_1l^{-\alpha 2}$$

where:

$B_i$ are the coefficients of the terms.

The spurious emanations are the outputs due to the third and fourth terms. These are tones present in the output sound which are not present in the input signal.

CONCEPTS OF THE INVENTION

Figure 1:
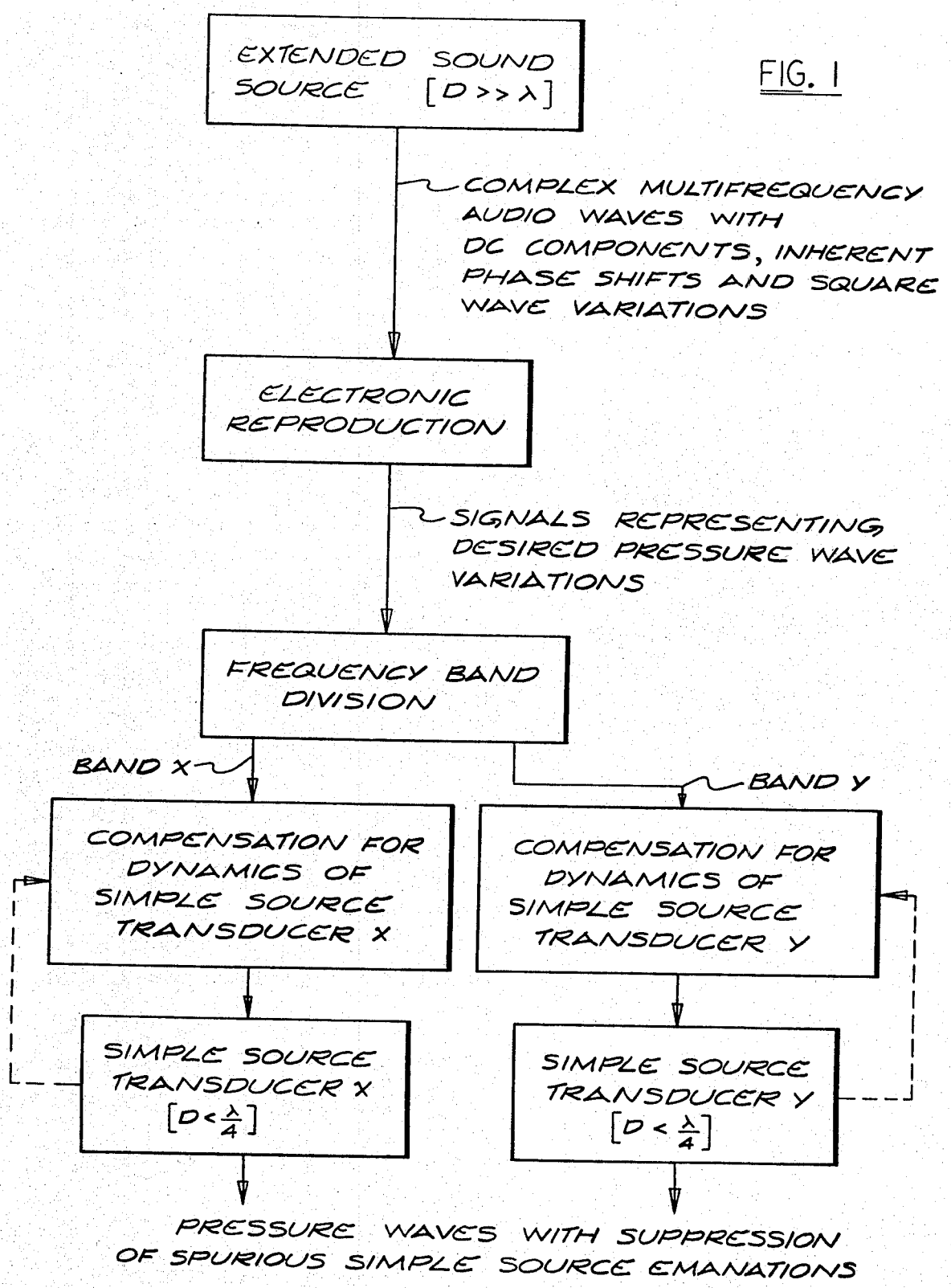
FIG. 1 is a block diagram of steps of a method for effectively eliminating spurious simple source emanations in accordance with the invention.

The problem of spurious emanations from a simple source that is reproducing complex waves has heretofore not been treated in the literature, as far as is known. There are both electronic and acoustic solutions to the problem, and both are encompassed within the scope of the present invention, although they are implemented in substantially different ways. Essentially, as shown in FIG. 1, methods and apparatus in accordance with the invention utilize the transduction of signals from a sound source into sound, by one or a number of simple sources, while shifting the spurious emanations into an inaudible range. Once the acoustic signals are in electrical form, the techniques of the invention can be applied, whether the audio is generated from an intermediate source such as a disk or tape recording, or otherwise. However, most high fidelity systems involve an intermediate storage or a reproduction medium, whether a tape, disk, or receiver. In any event, the concepts are applicable wherever the acoustic sources generate typical audio material, such as speech or music, which is multifrequency, time varying in characteristic, and not merely pure or continuous tones.

The electrical signals representing desired pressure wave emanations are divided into separate frequency bands, corresponding in number and range to the transducers (here designated X and Y, although any number may be employed) selected. The dynamics of each transducer are compensated, either electronically or acoustically or both, to cause the transducer to generate pressure waves without attendant spurious simple source emanations that are audible to the human listener. For a low frequency transducer, the emanations may be shifted to a region in which the transducer and human ear are very inefficient. For higher frequency transducers, the spurious emanations cannot be shifted to a different range, because the ear may be even more sensitive. Here the emanations should be of frequency and amplitude such that the ear is sufficiently insensitive to ignore them.

The preferred method of transducing these signals into sound without spurious simple source emanations is to electronically modify the driving signals for the transducers so as to render spurious emanations substantially inaudible. This has the advantage of utilizing the reliability and flexibility of electronic circuits, while permitting existing loudspeakers to be used. The characteristics of the transducer system can be defined, the resonances identified, and the transducers can be so driven that a linear response, consistent with the presently advanced state of the art, is achieved that is free of the spurious emanations. The result is a clarity and fidelity of reproduction that is apparent with all loudspeakers, and most apparent under the demanding conditions of high quality recording and high performance loudspeakers. This improvement is further demonstrable in terms of response to step function inputs, characteristic sound such as the human voice having unidirectional components, and difficult extended sources such as pianos and horns.

The acoustic implementation also utilizes an interaction with the transducer, but effectively shifts the resonant frequency of the transducer into a region in which it is in an inaudible range. This may result either from the resonant frequency being brought so low that it is in a highly inefficient region, or well below the crossover frequency and therefore very inefficiently transmitted.

Figure 4:
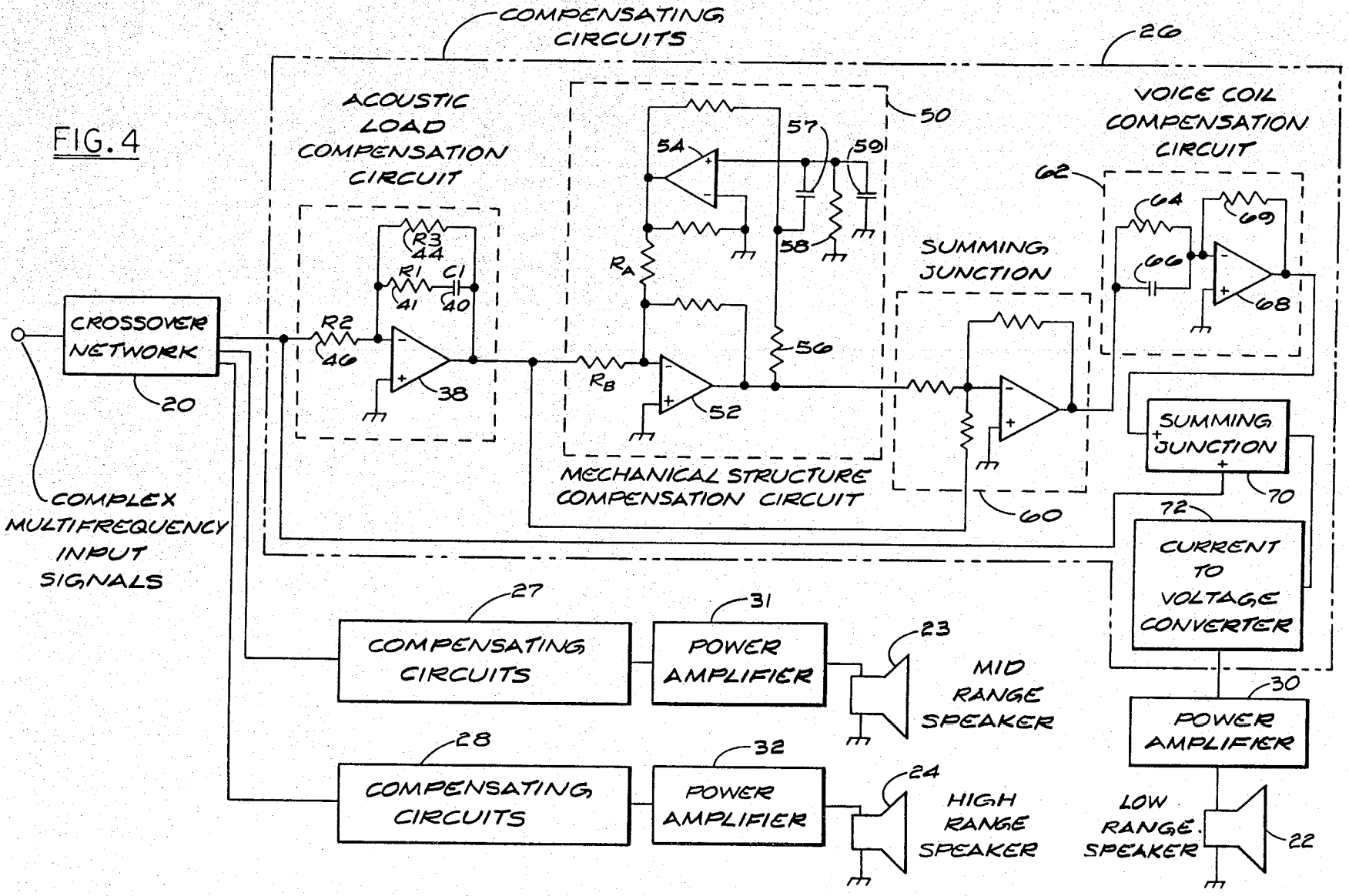
FIG. 4 is a combined block and schematic circuit diagram of the arrangement of a voltage mode feedforward system in accordance with the invention.

The system of FIG. 4 provides an example of a versatile and relatively inexpensively realized system for driving three electrodynamic transducers with audio signals so as to provide sound reproduction with suppression of spurious simple source emanations. The input signals comprise complex multi-frequency waves covering the humanly audible sound spectrum (e.g., 20–20,000 Hz), and are divided by a crossover network 20 into three adjacent frequency bands corresponding to the effective ranges of a low range speaker (woofer) 22, a midrange speaker 23, and a high range speaker (tweeter) 24. It will be understood that a greater or lesser number of speakers can be used, and that the frequency bands would then be divided accordingly. The different frequency bands may be established with predetermined edge band or "cut on" characteristics, as described hereafter in conjunction with the example of FIG. 7, so that the crossover circuits interact with subsequent circuitry to avoid an overtravel condition that might arise. In this example, the speakers and enclosure are an AR-11 type system sold by Acoustic Research, Inc., in which the woofer 22 covers the frequency band from 20 to 500 Hz and has a resonant frequency of 42 Hz, the midrange speaker 23 covers the range from 500 to 5000 Hz, with a resonant frequency of 400 Hz, and the tweeter 24 covers the range from 5000 to 20,000 Hz and has a resonant frequency of 4000 Hz.

Figure 5:
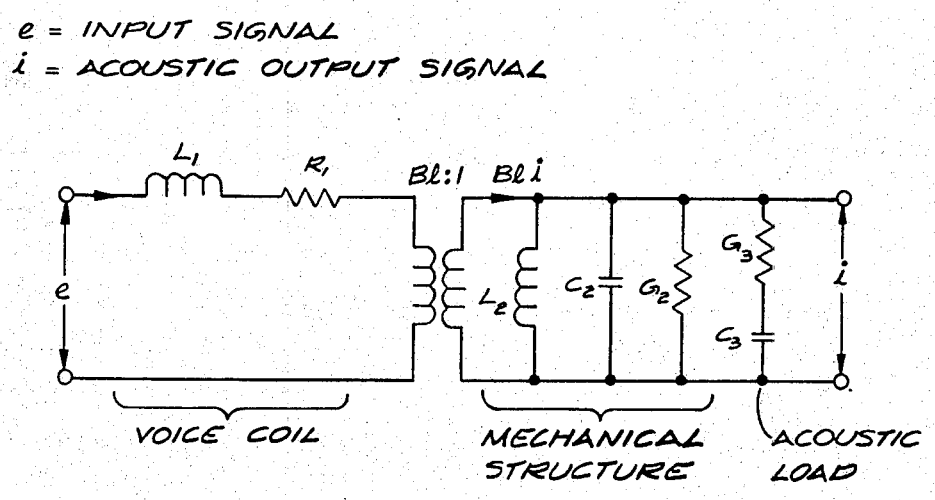
FIG. 5 is an idealized representation of a force-current circuit analog of a speaker system, useful in describing another system in accordance with the invention.
Figure 3:
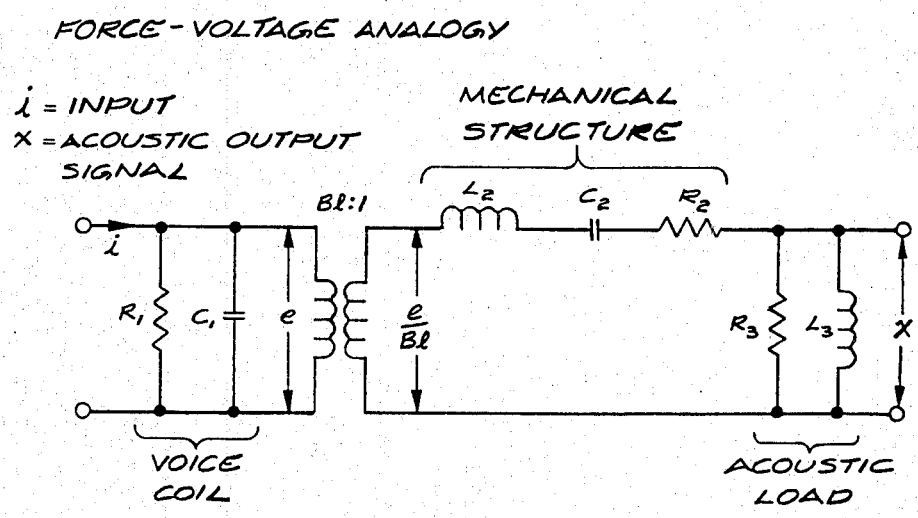
FIG. 3 is an idealized representation of a force-voltage circuit analog of a speaker system useful in describing the invention.

By manufacturer's specification, measurement or calculation of the essential electrical analogs of the acoustic and mechanical properties of the elements of this system can be established, in accordance with known models of a speaker system, such as those used by Beranek. Referring to FIG. 3, the analogous force-voltage circuit for a speaker is shown, and the terms have the following equivalents:

$G_1=1/R_1$=voice coil conductance
$C_1=L_1$=voice coil inductance
B=magnetic field-voice coil coupling
$L_2$=voice coil and cone mass
$C_2$=mechanical compliance
$R_2$=mechanical damping
$R_3$=acoustic damping
$L_3$=acoustic mass The circuit has resonances defined by the various parallel and serial LC circuits, and in the AR-11 the values for the woofer 22 may be given by way of example as $G_1=0.385$ mho, $C_1=2\times10^{-3}$ Farad, B=8.71 Newton/Amp, $L_2=0.066$ Kg, $C_2=1.99\times10^{-4}$ Newton/meter, $R_2=4$ Newton sec/meter, $R_3=21.2$ Newton sec/meter, and $L_3=0.0076$ Kg. In the circuit analogy of FIG. 3, the "signal in" and "signal out" are shown at positions corresponding to those used in FIG. 4, for ease of reference. The analogous force-current circuit employs inverse elements as shown in FIG. 5 and is also discussed in the literature.

Referring again to FIG. 4, each speaker 22, 23, and 24 receives energizing signals via a different compensating circuit 26, 27, and 28 respectively and separate power amplifiers 30, 31, and 32 respectively. The compensating circuits are matched to the characteristics of the individual speaker so as to correct for the dynamic response of the individual electrodynamic element as well as the inherent circuit elements. As seen in the compensating circuits 26 for the woofer 22, the input signals are applied first to an acoustic load circuit 36, constituting the inverse of the acoustic load term in the system. For this function, one (+) input of an operational amplifier 38 is grounded, and the other (−) input is coupled in a parallel feedback loop including a series RC circuit having a capacitor ($C_1$) 40 and resistor ($R_1$) 41, and a shunt resistor ($R_3$) 44, with a resistor ($R_2$) 46 also in the input path. The RC circuit compensates for the cutoff characteristic exhibited by the acoustic load. In this circuit, the $R_3$ resistor 44 which functions as a bleed resistor, is substantially larger than the $R_1$ resistor 41. The ratio of output voltage $e_o$ to input voltage $e_{in}$ is determined by the transfer function $$\frac{e_o}{e_{in}}=\frac{1}{R_2}\;\frac{1+R_1C_1S}{R_1C_1S},$$

where the output voltage $e_o$ is proportional to the current ($I_L$) in the acoustic impedance. The feedback circuit arranged in this way defines the compensating or inverse response for the acoustic load term in the analog of FIG. 3 that is defined by the parallel combination of $R_3$ (acoustic damping) and $L_3$ (acoustic mass), namely $$\frac{i_{out}}{e_{in}}=\frac{1+\frac{L}{R}S}{\frac{L}{R}S}$$

The output signal from the acoustic load circuit 36 is applied to compensating circuit 50 matched to the dynamics of the mechanical structure of the woofer 22.

The transfer function of this circuit, using the element designations of FIG. 3, is $$\frac{e_o}{e_{in}}=\frac{R_a}{R_b}\;\frac{1}{H_o}\;\frac{S^2+\alpha W_oS+W_o^2}{\zeta W_oS}$$

where $\alpha=1/Q=(5-K)/2$
$W_o=2\pi f_o$, the resonant frequency
$=RC/2$
$H_o$=mid-band gain of filter
$=(5Q/2)-1$ This is similar in form to the transfer series function for the R-L-C circuit for the mechanical speaker structure $$\frac{e_{out}}{i_{in}}=R\,\frac{1+\zeta W_oS+W_o^2S^2}{\zeta W_oS}$$

where:

$W_o^2 = 1/LC$ $\zeta = R/W_oL$

Thus if the input voltage is proportional to a current, then the circuit is directly analogous to the mechanical circuit. For this transfer function, first operational amplifier 52 has a ngative feedback loop including a second operational amplifier 54 which cooperates to provide an active filter function. A resistor-capacitor series 56, 57 respectively and a parallel resistor 58 and capacitor 59 are arranged so that the circuit 50 functions as a band reject filter, and acts to compensate for the resonance of the mechanical structure by acting inversely in terms of frequency response. The thus compensated signal is a voltage corresponding to that across the mechanical structure in the force-voltage analog of FIG. 3.

In the circuit of FIG. 4, the input summing resistors $R_a$ and $R_b$ correspond to those shown in the equation.

The input signal derived from the crossover network 20 and the output signal from the ciruit 50 are summed together in a summing junction 60 and the summed signal is applied to a voice coil-anti-resonance circuit 62. A passive circuit comprising a resistor 64 and capacitor 66 in parallel coupling the input signal to an operational amplifier 68 coupled by a feedback resistor 69 provides pre-compensation for the voice coil conductance $G_1$ and inductance $L_1$ in the analogous circuit of FIG. 3. The transfer function of this circuit is $$e_{out}/e_{in} = (R\ 69/R\ 64)(1 + R_{64}C_{66}S)$$

which has the same form as the transfer function of the R-C voice coil circuit $$L_{out}/e_{in} = 1/R(1 + RCS)$$

The circuit 62 output is combined with the output from the acoustic load circuit 36 in a summing junction 70. The combined signal is a current which represents the sum of two current levels, and is converted to a low impedance voltage signal in a current to voltage converter 72. Then the signal is coupled to a power amplifier 30 and applied to the speaker 22. The operational amplifiers shown in all the circuits may be Fairchild type VA 741 and the power amplifier may be any conventional driver, such as a Heathkit 150. Although not shown in detail, the compensating circuits 27, 28 for the mid range speaker 23 and high range speaker 24 are matched in corresponding fashion, to provide compensated low impedance outputs. The transducers 22, 23, 24 each comprises a simple source, in which the diameter of the radiating area is less than approximately one-quarter of a typical wave length. When the complex multi-frequency input signal is divided by the crossover network 20 into the three adjacent bands corresponding to the operating frequency band for each speaker, separate input signals are each presented to a speaker 22, 23, or 24 of different characteristics. Referring to the channel coupled to the low range speaker 22, it can be seen that the input signal applied to the acoustic load compensating circuit 36 produces a velocity signal, in the form of a current, $i_L$ that is forced to flow through the compensating circuit 50 corresponding to the mechanical structure. This circuit 50 generates an output voltage which is combined with the input voltage and the summing junction 60, supplying a summed output voltage which is applied to the voice coil compensating circuit 62, giving an output current that is coupled to one input of the summing junction 70. The current $i_L$ from the acoustic load circuit 36 is also coupled to the summing junction 70, providing the desired complex multifrequency wave that is precisely compensated for all of the dynamic characteristics of the acoustic, electrical, mechanical and magnetic characteristics of the system. The result is that the input electrical signal is converted to a driver signal that corresponds to the desired signal needed to generate the corresponding sound pressure wave sequence. The current-to-voltage converter converts the signal from a high impedance to a low impedance output, as is commonly employed for driving a power amplifier 30 and a subsequent speaker 22.

It can further be seen that there is compensation for spurious simple source emanations, regardless of the factors giving rise to them. Thus the fact that the sound being reproduced was originally produced by an extended source, or contains a substantial DC component, sharp leading or trailing edges, or phase shifts in the region of resonance, the transducer is operated so as to minimize the effect. In essence, the large sinusoidal variation in FIG. 2C at a period of 1/f is eliminated. The circuits in accordance with the invention insure that the resonance for each transducer is in a region of extremely low efficiency, or very low energy, or both, so that the spurious emanations are effectively inaudible and the speaker becomes what may be termed a virtual extended source. For the low range speaker this function is aided by the fact that the human ear itself becomes increasingly less efficient at lower frequencies. For the mid range and high range speakers, however, the ear may become even more sensitive by the suppression of the basic spurious emanations in one frequency region and appearance of such emanations in another frequency region. Consequently, it is important that these be established well outside the region of efficient operation of the speaker and in addition held to a minimum.

Figure 6:
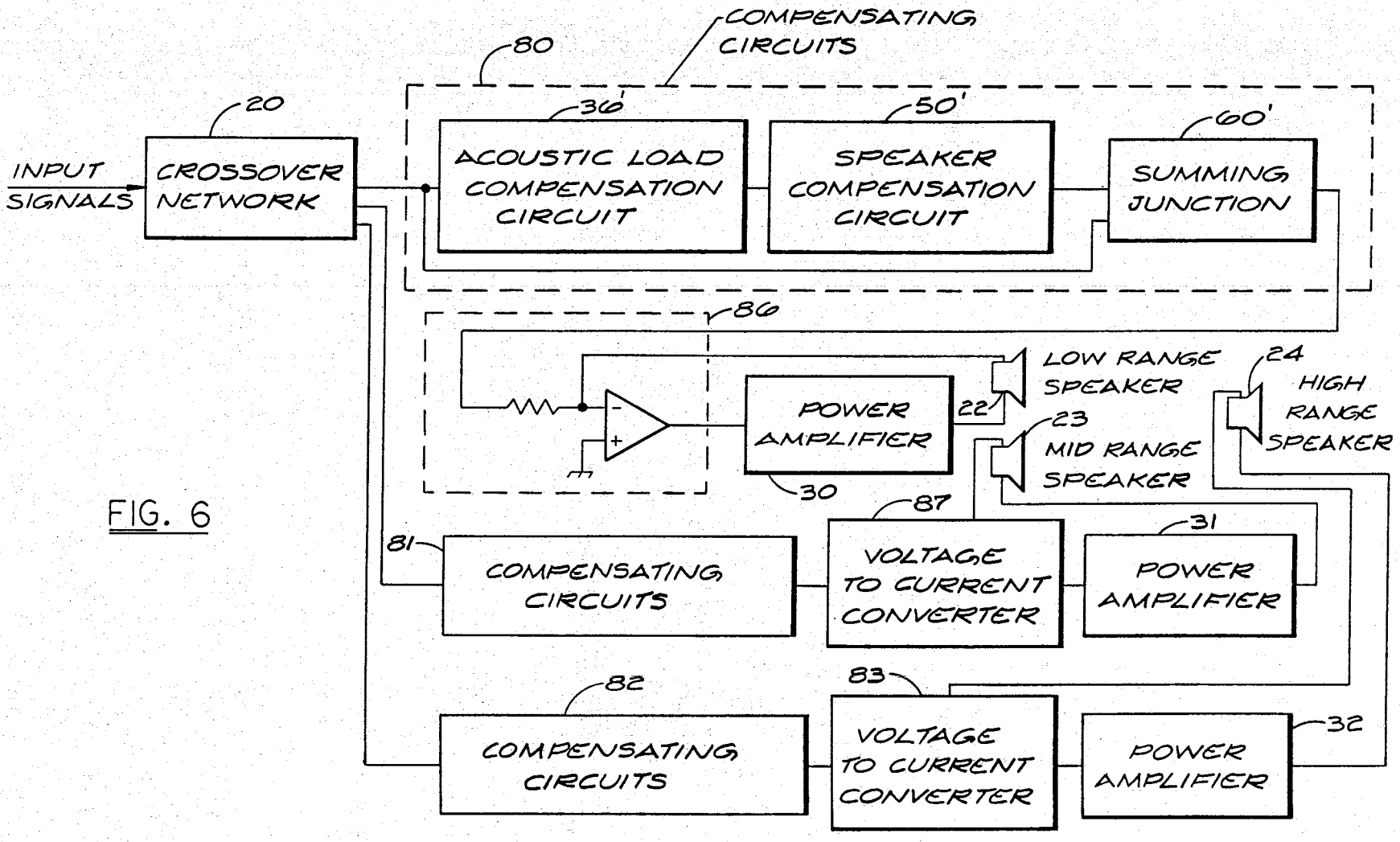
FIG. 6 is a combined block and schematic circuit diagram of a current mode feedforward system in accordance with the invention.

The force-current analogy is depicted in FIG. 5, and inasmuch as it is of conventional form need not be described in detail, although it will be noted that the elements are the inverse of those previously depicted in the example of FIG. 3. In the detailed current mode exemplification of a system for suppressing spurious simple source emanations shown in FIG. 6, subsystems that correspond identically or in substantial detail to those previously described in conjunction with FIG. 4 are similarly numbered, or differ only by a prime designation. The compensating circuits 80, 81, and 82 for the separate channels each contain an acoustic load compensating circuit 36', a speaker compensating circuit 50', and a summing junction 60', arranged as previously described. However the output of the summing junction 60', being a voltage varying signal, is applied to a voltage-to-current converter 86, as shown in the channel for the low range speaker 22. The output of the circuit 80 is in series, through the power amplifier 30, with the coil of the low range speaker 22, which therefore is directly responsive to the current variations, and no voice coil compensation is needed in the system. Although this system functions satisfactorily and in accordance with the invention, the use of a high impedance current output affects the Q of the system, typically raising it higher than is desired, and is generally preferred to utilize the voltage mode, in which the Q is maintained at a conventional value of about 1, rather than add additional circuitry to deal with this problem.

In the mid range channel, therefore, the compensating circuits 81 and voltage-to-current converter 87 are arranged in similar fashion, as are the compensating circuits 82 and voltage-to-current converter 88 for the high range speaker 24. Again, the result is the same as in the force-voltage type of system, in that a signal is generated to drive the speakers that corresponds to the force needed to give the required pressure wave variations, irrespective of the individual characteristics of the different speakers.

Figure 7:
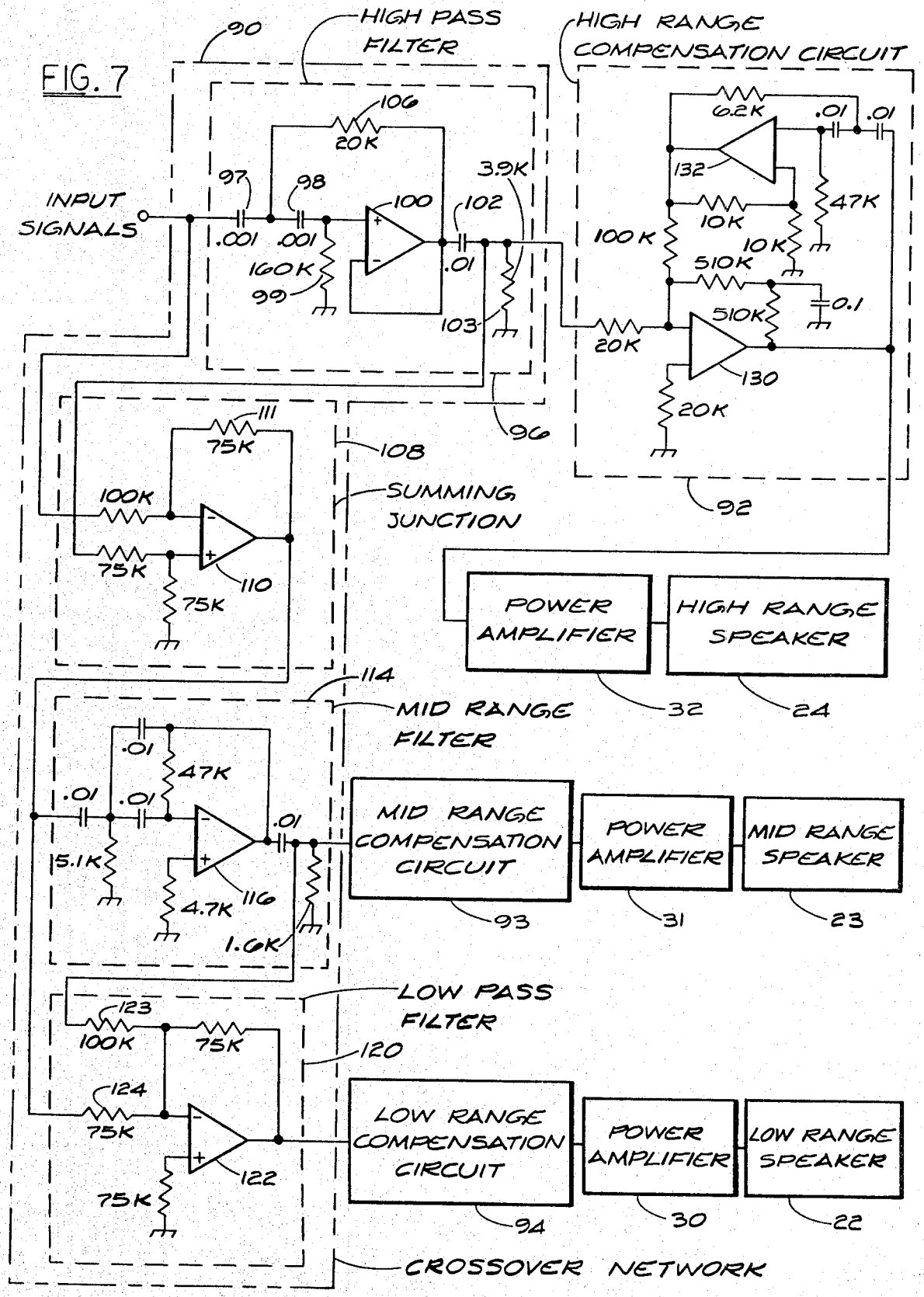
FIG. 7 is a combined block and schematic circuit diagram of a crossover network and simplified feedforward system in accordance with the invention.

The example of FIG. 7 provides both a simplification in some respects of the techniques for suppressing spurious emanations, and an extension of the technique to achieve an interaction between the crossover network and the anti-resonant circuits. As in the prior examples, the input signals are divided into three channels for driving the high range, mid range and low range speakers 22, 23, and 24 respectively. In the crossover network 90, signals are generated for a high range compensating circuit 92, a mid range compensating circuit 93 and a low range compensating circuit 94, each of which may be generally of the form shown in the high range circuit 92, to be described hereafter. In the crossover network 90, a high pass filter 96 provides a "cut on" response of 18 db/octave and a substantially linear operation above 1000 Hz. An input coupling capacitor 97 and an input tuned circuit comprising a capacitor 98 and a resistor 99 feeding one input of an operational amplifier 100, together with another RC network comprising a capacitor 102 and a resistor 103 as shown, in conjunction with a feedback resistor 106, provide the desired slope for the frequency response in the turn on region. The output signal is applied to the high range circuit, and in a separate circuit path is combined with the input signals and a summing junction 108 including an operational amplifier 110 having a feedback resistor 111, as shown. The characteristic of this circuit is that it cuts off the high end of the mid range band at a constant 6 db per octave, feeding this signal to the mid range filter 114, which includes an operational amplifier 116 having RC networks in the input, output, and feedback loops to provide a 12 db/octave characteristic at each end of the range from 1000 Hz down to 300 Hz. This output signal is applied to the mid range circuit 93, and also to a low pass filter 120 having a 12 db/octave cut on characteristic, and including an operational amplifier 122, one input of which receives the summed signals derived through a pair of resistors 123, 124 from the mid range filter 114 and the summing junction 108.

Figure 8:
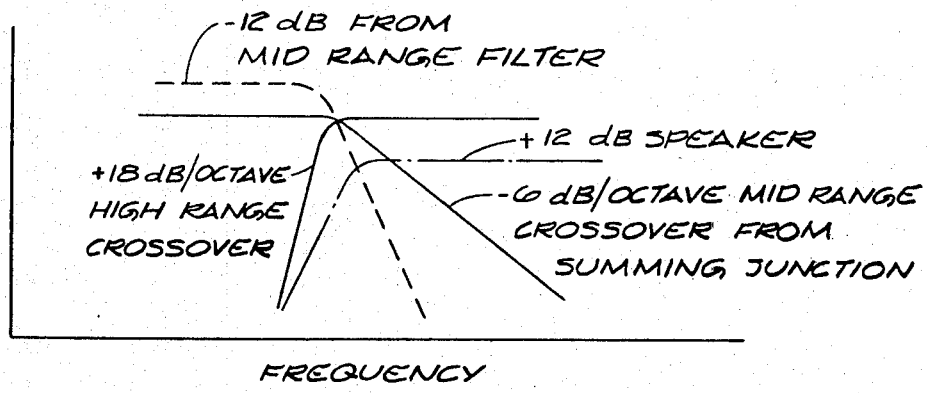
FIG. 8 is a graphical representation of frequency response curves useful in explaining the arrangement of FIG. 6.

The active networks in the crossover network 90 therefore introduce a deliberate disparity between the characteristics of the low end of the high frequency band and the high end of the low frequency band, although the remaining overlaps between adjacent bands are arranged to reconstitute the input signals. The +18 db/octave high range crossover and −6 db/octave mid range crossover derived at the output of the high pass filter 90 and summing junction 108 are depicted in the correspondingly designated curves in FIG. 8.

In the high range compensating circuit 92, a pair of operational amplifiers 130, 132 are arranged in a principal path and feedback path so as to provide the equivalent of the mechanical structure compensating circuit as previously described. However, in this simplified structure it is assumed that the acoustic load is all inductive and that the coil has zero inductance. These assumptions do not substantially decrease the quality of performance, while substantially decreasing the number of active circuit elements utilized in the system. However, the compensating circuit has a cut on characteristic of 12 db, substantially matching the response of the high range speaker 24. The presence of the 18 db/octave characteristic and the signal from the high pass filter 96 is used to cause the compensating circuit response to a square wave input to fall off rather than to continue to rise in the fashion required for the ideal response, which would require over travel of the speaker and give rise to the cone breakup condition. This situation, however, in turn gives rise to the presence of an artificial spurious emanation in the crossover region, due to the disparity in the cut on characteristics. This spurious emanation is itself effectively cancelled by feeding a component of the signal from the high pass filter 90 into the summing junction 108 and thence into the mid range filter 114 in an opposite sense. Consequently, the mid range speaker 23 is excited with a directly opposite and compensating motion, and the result is a complete acoustic cancellation of the spurious emanation. Care should be taken to insure that the speakers 23, 24 are properly spatially oriented to make best use of the cancellation effect.

Figure 10:
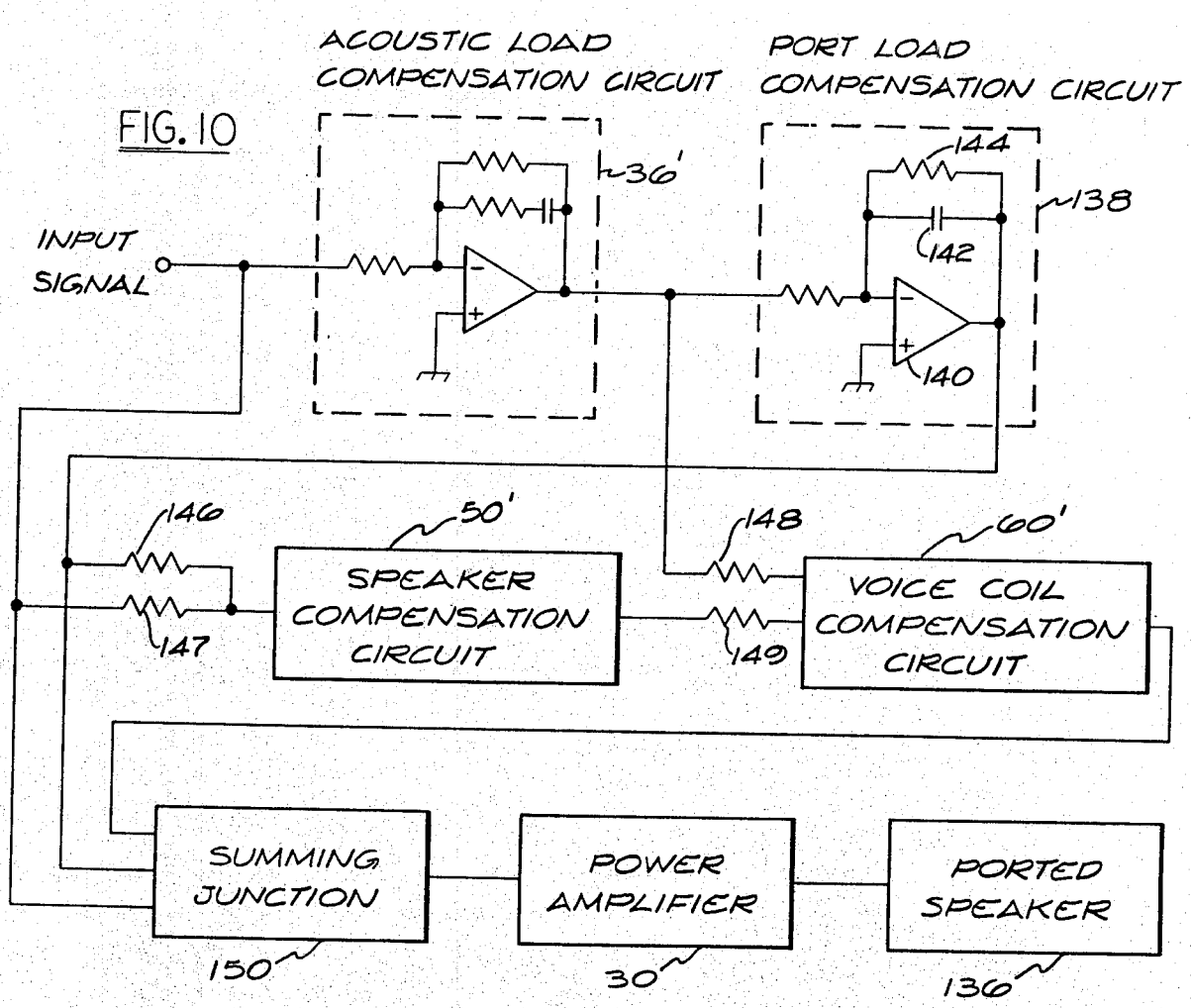
FIG. 10 is a combined block and schematic diagram of a feedforward system in accordance with the invention for use with a ported speaker.
Figure 9:
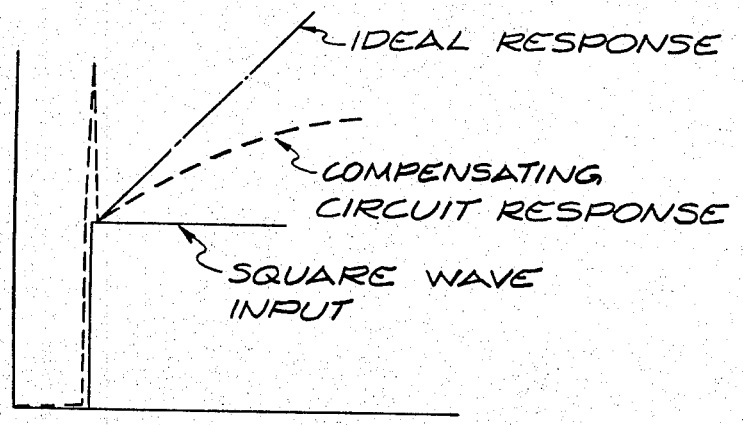
FIG. 9 is a graph of waveforms also useful in explaining the arrangement of FIG. 6.

A different condition is presented when a ported speaker 136 is employed, as illustrated generally in the example of FIG. 10. In this event, the effect of the port is to introduce a different type of acoustic load, similar to but separate from the acoustic load previously discussed in conjunction with the compensating circuit 36'. The port load compensating circuit 140 is therefore introduced to receive the current varying signal from the acoustic load compensating circuit 36', and includes principally an operational amplifier 140 with a capacitor 142 and shunting resistor 144 in the feedback path. The output from the port load compensating circuit 138 and the input signal are summed together at a pair of summing resistors 146, 147 and applied to the speaker compensating circuit 150', with the output from that circuit and the output from the acoustic load compensating circuit 36' being summed together and applied through a pair of resistors 148, 149 to the voice coil compensating circuit 60'. A summing junction 150 receives the input signal, the signal from the port load circuit 138 and the signal from the voice coil circuit 60' and applies these through a power amplifier to the ported speaker 136. This system effectively combines the different components to compensate for the electrical, mechanical, acoustic and magnetic characteristics of the ported speaker.

Figure 11:
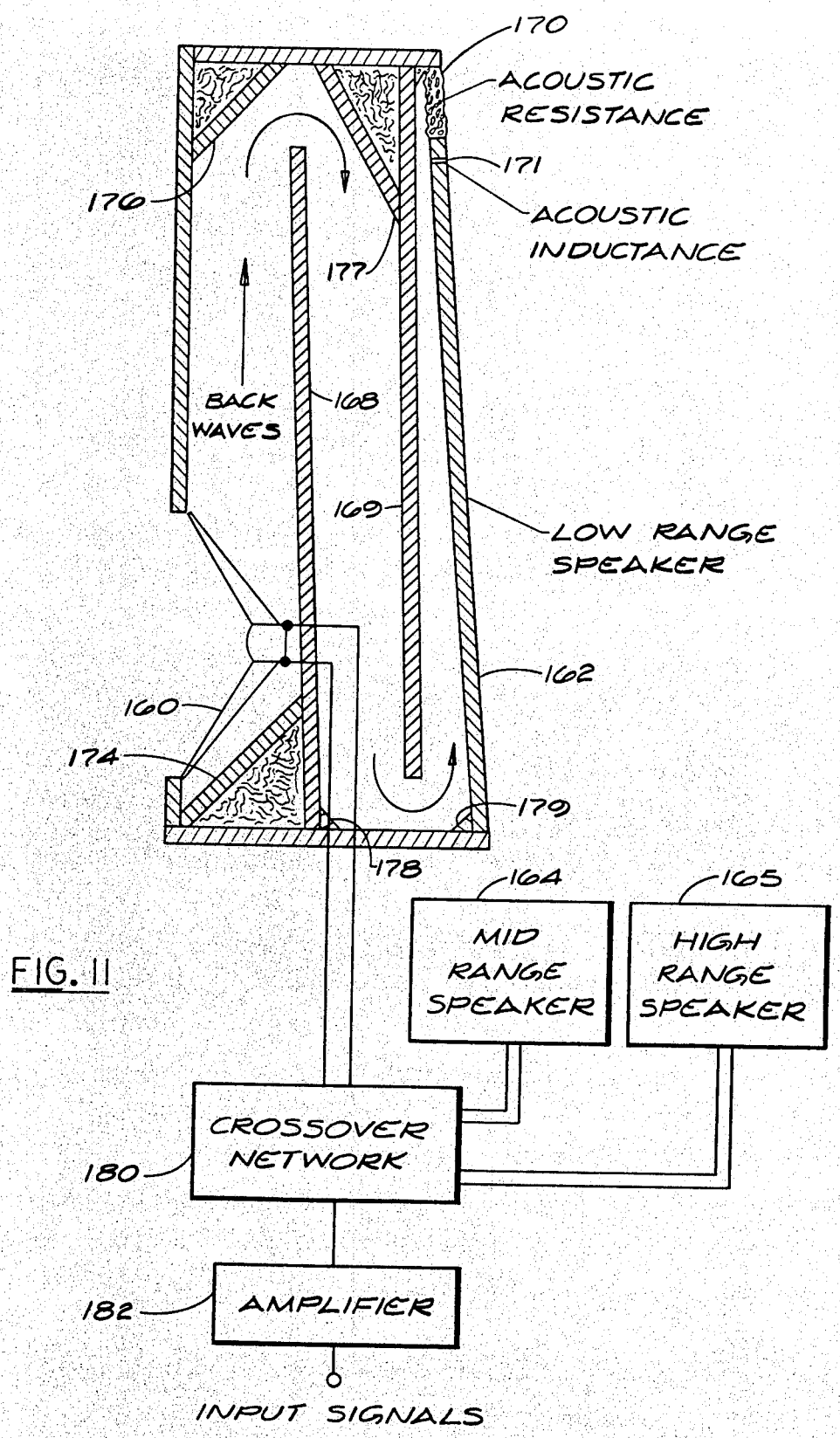
FIG. 11 is a simplified side view, partially in section and partially in block diagram form, of an example of an acoustic system for minimizing spurious simple source emanations in accordance with the invention.

The spurious emissions from a simple source may be suppressed acoustically as well as electronically. Again an interrelationship is established between the known characteristics of a low range transducer 160 mounted in an enclosure 162. Similar arrangements are used for a mid range speaker 164 and a high range speaker 165. In each case, however, the compensating coupling comprises a reversed exponential horn system matched to the transducer dynamics. A true exponential horn shape may be used, where space permits, but a folded approximated horn system provides a more compact structure at no substantial loss of performance. In FIG. 11, the enclosure 162 in communication with the back of the transducer 160 has a diminishing cross section defined by a sinuous pathway established by successive internal dividers 168 and 169 leading to an acoustic termination comprising an acoustic resistance 170 and acoustic inductance 171. In the immediate region of the transducer 160 the interior volume is substantially closed off on the side opposite the reversed horn pathway by a diagonal closure 174 so that acoustic waves are directed along the pathway. Similar angled closure members 176, 177, 178, and 179 are positioned across successive corners to smooth the transitions around the corners at which wave directions are reversed.

At the termination of the pathway the acoustic resistance 170 comprises a glass wool body. Also an acoustic inductance 171 in the form of a small aperture is provided in the wall of the enclosure 162 adjacent the termination. In this instance the transducer 160 is a bass speaker having a cutoff frequency of approximately 30 Hz. The acoustic resistance and parallel acoustic inductance are arranged to give an acoustic reactance at the horn throat of approximately 42 gm/cm sec at and above the horn cutoff frequency, $f_o$, determined by $$f_o = c/2\pi x_o,$$

where c is the velocity of sound and $x_o$ is the characteristic length parameter of the horn.

Figure 12:
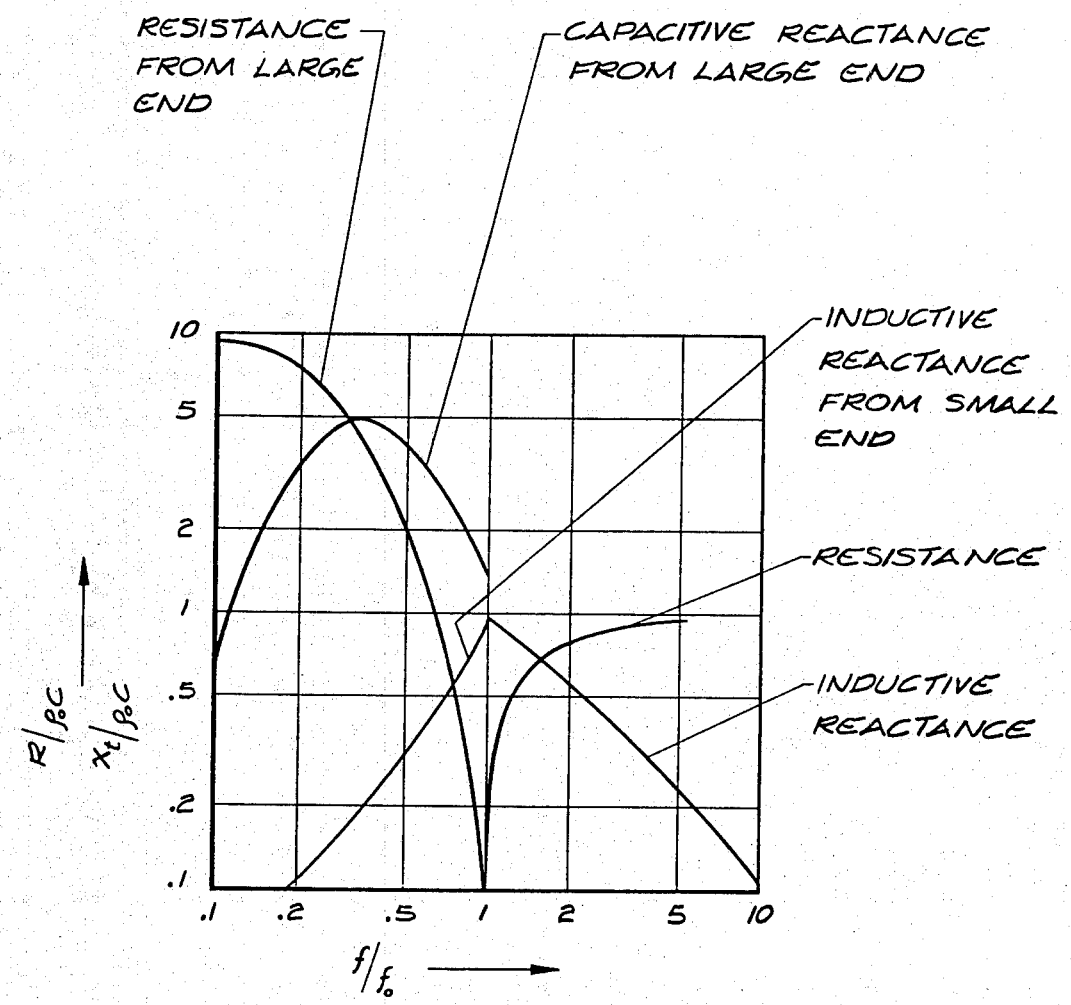
FIG. 12 is a graph depicting the characteristics of an exponential horn that is utilized in the example of FIG. 11.

FIG. 12 shows the characteristics of an exponential horn. It may be seen here that above the cutoff frequency $f_o$ the impedance of an exponential horn consists of an inductive reactance that rapidly diminishes with increasing frequency as well as a resistance that increases rapidly from nearly zero at cutoff frequency $f_o$ to a fixed value equal to $\rho_o c$. At frequencies below the cutoff frequency the characteristics of the exponential horn change drastically. When seen from the small end of the horn, the impedance consists of a decreasing inductive reactance in conjunction with a rapidly decreasing resistance, both diminishing as the frequency is lowered. Looking backwards into the horn, however, from the large end, the impedance consists of a capacitive reactance that increases, as frequency is lowered, to a certain value which is dependent on the termination employed at the small end of the horn. This said termination also determines the characteristics of the resistive part of the impedance below cutoff frequency $f_o$. The exponential horn is but one special case of a whole family of horns. All of them have a discontinuous characteristic at cutoff frequency. In order for the backloading of the acoustic driver to perform its correct function, the horn must be designed to be one of the horns displaying this discontinuous characteristic, and be operated in the below cutoff range.

In the system of FIG. 11, the long inverted horn in acoustic communication with the transducer 160 provides a large backloading inductance that interacts to lower the resonant frequency of the transducer 160. In one practical example the transducer 160 was a 12 inch woofer with a 19 ounce magnet, and the exponential horn system had an opening equal to the piston area on the speaker (about 500 $cm^2$) at an end, decreasing in area at an approximately exponential rate, with an $x_o$ of 340 cm. The characteristic resonant frequency of the speaker system was thereby lowered from approximately 90 Hz to approximately 15 Hz.

The effect on the back wave traveling in the reversed horn structure is a diminution in amplitude so that it ultimately encounters a matched termination in the form of the acoustic impedance at the small end. The inductive backloading does not affect higher frequency response because the acoustic reactance disappears at frequencies well above the cutoff level. Inductive backloading of this type used in each of the speakers 162, 164, 165 substantially reduces spurious simple source emanations.

In the practical example mentioned the mid range speaker 164 was coupled to a reversed horn having a resonance of 86 Hz, and the high range speaker was coupled to a reversed horn having a resonance of 700 Hz. The speakers were fed from a crossover network having a 6 db/octave crossover characteristic. In the mid and high ranges it will often be useful to employ an open baffle construction. The open baffle has a constant efficiency output at all frequencies above the frequency determined by its dimensions, but its efficiency declines in proportion to the fourth power of the frequency below that point. Thus, the open baffle can aid in assuring that spurious emanations are rendered inaudible by being forced into an extremely low powered domain for the speaker.

While various expedients and modifications have been suggested above, it will be appreciated that the invention is not limited thereto but encompasses all forms and variations within the scope of the appended claims.

What is claimed is:

1. The method of generating acoustic pressure waves corresponding to complex electrical audio signals while using a simple source transducer comprising the steps of:

generating electrical signals from the audio signals that compensate the mechanical characteristics of the transducer to provide the force variations required for the transducer by electronically modifying the electrical signals in accordance with inverse analogs of at least the mass, damping and compliance characteristics of the transducer system, the acoustic load and the inherent electrical impedance characteristics of the transducer to alter the spurious emanations of the transducer to a frequency region or an amplitude, or both, at which they are substantially inaudible.

2. The method as set forth in claim 1 above, wherein the reduction of spurious simple source emanation comprises the step of acoustically compensating for at least the mass, compliance and damping of the transducer to modify the spurious emanations to a low efficiency range of the transducer.

3. The method as set forth in claim 2 above, wherein the acoustical compensation is effected by inductively backloading the transducer.

4. The method as set forth in claim 3 above, wherein the inductive backloading is effected by diminishing the volume of the back wave from the transducer and then terminating the wave without reflection.

5. The method of responding to audio signals to generate acoustic wave energy with transducers operating in different frequency bands so as to generate acoustic energy throughout the humanly audible region comprising the steps of:

dividing the audio signals into frequency bands corresponding to the different frequency bands of the transducers;

modifying each signal is a different frequency band with an inverse analog of the signal responsive characteristics of the transducer operating in that band such that the modified signals are proportional to the forces required to drive the transducer to effect velocity changes that will result in the generation of pressure waves with minimal audible spurious emanations, proportional to the original audio signal;

modifying each signal in a different frequency band with an inverse analog of the acoustic load on the transducer, the acoustic load having a cutoff characteristic; and exciting each transducer with the modified signal for that band to create pressure variations corresponding in sum to the original audio signals.

6. A method as set forth in claim 5 above, wherein the division of frequencies provides a continuum across the acoustic spectrum with overlap in the crossover region.

7. A method as set forth in claim 6 above, including in addition the steps of introducing signal components of opposite phase in signals in at least one crossover region and acoustically cancelling the signal components.

8. A method as set forth in claim 7 above, wherein a spurious emanation signal component is introduced in a higher frequency band in the crossover region with the next lower frequency band, and an opposing signal component is introduced in said next lower frequency band.

9. A method as set forth in claim 8 above, wherein the cut-on characteristic of the higher frequency band is arranged to limit excursion of the transducer while introducing the spurious emanation signal component.

10. The method of reproducing sound originally emanating from an extended source with a transducer appearing as a simple source and having a transverse dimension substantially smaller than the average wavelength being generated in a complex multi-frequency sound sequence, comprising the steps of:

processing signals representing the complex multifrequency sound sequence that is desired;

compensating the signal in accordance with inverse analogs of at least the mass, damping and compliance of the transducer, the inherent electrical characteristics of the transducer and the acoustic load on the tranducer whereby spurious emanations in the normal operating range of the transducer are counteracted and spurious emanations are shifted to a frequency region at which they are inaudible for the transducer; and driving the transducer with the compensated signal.

11. The method as set forth in claim 10 above, wherein the signal is modified to provide current mode operation of the transducer.

12. The method as set forth in claim 10 above, wherein the signal is modified to provide voltage mode operation of the transducer.

13. A system for generating, for simple source transducers operating in different frequency ranges, complex sounds corresponding closely to those emanating from original sources in response to electrical signals representative thereof, comprising:

crossover network means responsive to the electrical signals and providing selected cutoff points for each frequency band corresponding to the frequency range of the transducers;

separate amplifier means coupling the crossover network means to the different transducers to provide pressure wave variations consistent with the capability of the transducers for following the motions demanded by the signals; and separate electronic active circuit means responsive to the electrical signals separately coupled to each of the different transducers and coupled to the means for exciting the transducers for nullifying the effect of at least the transducer mass, compliance and damping, and the acoustic load for reducing spurious simple source emanations from each of the transducers to below a significantly audible level.

14. A system as set forth in claim 13 above, wherein said electronic circuit means further comprises means providing an inverse analog of the transducer characteristics.

15. The invention as set forth in claim 13 above, wherein said means for reducing emanations comprises acoustic means coupled to said transducers for compensating for the response thereof.

16. A system as set forth in claim 15 above, wherein the transducers are each operative in a selected frequency band, and wherein said acoustic means comprises at least one inverted exponential horn for back waves having its larger end acoustically coupled to a transducer and impedance matching acoustic absorption means disposed in its smaller end, and wherein said horn is operated below its cutoff frequency.

17. An acoustic energy reproduction system responsive to electrical audio signals for generating, from moving coil loudspeakers, sounds that are substantially free of spurious simple source emanations, comprising:

at least two moving coil loudspeaker means operating principally in different regions of the audio band;

crossover network means responsive to the electrical signals for dividing the signals into the different frequency regions;

at least two amplifier means, each coupled to excite a different loudspeaker means for a different frequency region; and at least two analog circuit means, each in circuit with a different amplifier means, and responsive to amplitude and phase components in the signal for the associated frequency region each including means providing an inverse analog of the mechanical parameters of the associated loudspeaker means and the acoustic load on the loudspeaker means, the acoustic load variations having a cutoff characteristic, for nullifying spurious emanations in the frequency regions of the loudspeakers in real time.

18. The invention as set forth in claim 17 above, wherein the spurious emanations result from the inability of the loudspeakers to follow signals generated by extended sources, transient variations, phase shifts, and unidirectional components that are characteristic of complex multi-frequency audio sources, and wherein said analog circuit means each provide an analog of at least the mass, compliance and damping of the loudspeaker, and the acoustic load on the loudspeaker to alter the energization of the loudspeaker such that the frequency or amplitude, or both, of the spurious emanations are rendered substantially inaudible.

19. An acoustic wave generating system for audio frequencies comprising:

a transducer;

means coupled to drive the transducer with audio signals; and electronic analog circuit means responsive to amplitude and phase variations in the applied signals and coupled to the transducer, the electronic circuit means including means for providing inverse analogs of the mechanical mass, compliance and damping of the transducer, the properties of the acoustic load and the electrical impedance characteristics of the transducer for substantially cancelling spurious simple source emanations in the frequency range of the transducer to provide a virtual extended source.

20. The invention as set forth in claim 19 above, wherein said means for cancelling emanations comprises acoustic wave transmission means coupled to said transducer, and operated below its cutoff frequency said acoustic wave transmission means including impedance matching termination means.

21. A loudspeaker system for generating a clean and undistorted reproduction of complex audio waves comprising:

low frequency, mid-frequency and high frequency electrodynamic reproducer means;

means responsive to the audio waves for driving the reproducer means; and separate circuit means cooperative with the means for driving the reproducer means and coupled to the different reproducer means, the separate circuit means each comprising individual analog circuit means providing an inverse analog of the mechanical-acoustical system of the associated reproducer means to generate a signal corresponding to the force needed to drive the reproducer means to accurately reproduce the input signal by compensating for the characteristics of the reproducer means to render spurious simple source emanations effectively inaudible in each of the frequency ranges.

22. The invention as set forth in claim 21 above, wherein the analog circuit means each further include means providing an inverse analog of the acoustic load and voice coil of the associated reproducer means.

23. The invention as set forth in claim 21 above, wherein said means for rendering simple source emanations effectively inaudible comprises means for acoustically compensating for at least the mass, compliance and damping of the reproducer means.

24. The invention as set forth in claim 23 above, wherein said last mentioned means comprises reversed horns acoustically coupled to each of the reproducer means.

25. A system for driving an electromagnetic loudspeaker transducer having known mechanical parameters to provide pressure wave variations corresponding to the variations in a complex multi-frequency audio waveform, comprising:

first amplifier means responsive to the audio waveform for generating a first compensated signal therefrom modified in accordance with an inverse analog of the acoustic load on the transducer, the inverse analog corresponding to an acoustic load having cutoff characteristics;

second amplifier means responsive to the first compensated signal for generating a second compensated signal modified in accordance with an inverse analog of the dynamic response of the transducer, the second amplifier means comprising a negative feedback circuit;

summing means coupled to receive the second compensated signal and the audio waveform; and output amplifier means coupled to the summing means for driving the electromagnetic transducer.

26. The invention as set forth in claim 25 above, wherein the second amplifier means provides an inverse analog of the mass, compliance and damping of the transducer and the output amplifier means is a low impedance output circuit coupled to drive the transducer in a voltage mode.

27. The invention as set forth in claim 26 above, wherein the system further includes means coupled between the summing means and the output amplifier means for generating a third compensated signal modified in accordance with the voice coil parameters, and second summing means coupled to receive the first compensated signal and the third compensated signal and to provide a summed signal to the output amplifier means.

28. The invention as set forth in claim 27 above, wherein the transducer is contained in a ported enclosure, and wherein the first amplifier means comprises means providing an inverse analog of the ported enclosure characteristic, and wherein said summing means is coupled to receive the input signal, the first compensated signal and the third compensated signal.

29. The invention as set forth in claim 26 above, wherein the system includes means receiving the second compensated signal and provides an inverse analog of the voice coil resistance alone of the transducer and wherein the first amplifier means provides an inverse analog of the inductance alone of the acoustic load.

30. The invention as set forth in claim 25 above, wherein the output amplifier means is coupled in series with the transducer voice coil in a feedback loop and the transducer is driven in a current mode.

31. A system for reproducing sound from complex multi-frequency input waves with high clarity from a given electrodynamic speaker having known electrical and mechanical characteristics comprising:

input means providing a voltage varying input signal corresponding to sound to be reproduced in a selected frequency range;

compensating means comprising feed forward circuit means responsive to the input signal for modifying such signal in accordance with the characteristics of the mass, compliance and damping mechanical characteristics of the speaker, the acoustic load and speaker voice coil; and driver means comprising voltage mode amplifier means coupling the compensating means to the speaker for driving the speaker to produce pressure waves corresponding to the input waves irrespective of the mechanical, acoustic load and voice coil characteristics of the speaker.

32. A system as set forth in claim 31 above, wherein said feed forward circuit means comprises separate feed forward circuits for generating compensated signals for mechanical characteristics, acoustic load characteristics and voice coil characteristics, and means for summing the compensated signals.

* * * * *

UNITED STATES PATENT AND TRADEMARK OFFICE

CERTIFICATE OF CORRECTION

PATENT NO. : 4,340,778

DATED : July 20, 1982

INVENTOR(S) : Kenneth W. Cowans and M. Owen Bennett

It is certified that error appears in the above-identified patent and that said Letters Patent are hereby corrected as shown below:

Column 1, line 49, "improvmnt" should read --improvement--. Column 2, line 68, "mechanicalelectrical" should read --mechanical-electrical--. Column 3, line 32, "perferences" should read --preferences--. Column 7, line 46 should read $$--e(t) = E, \cos Wt + E_2 \sin Wt \text{ for } t \geq 0--$$

Column 8, line 13 should read $$--W_1\ 1^{-\partial 2}1t + B_4\ e^{-\partial t} \cos W_1\ 1^{-\partial 2}--$$

Column 11, line 6, "ngative" should read --negative--; line 19, "ciruit" should read --circuit--. Column 16, line 60, after "signal", "is" should read --in--. Column 17, line 37, after "the", "tranducer" should read --transducer--.

Signed and Sealed this

*Twenty-first* Day of *December 1982*

[SEAL]

*Attest:*

GERALD J. MOSSINGHOFF

*Attesting Officer* *Commissioner of Patents and Trademarks*